US006328788B1

(12) United States Patent
Auger

(10) Patent No.: US 6,328,788 B1
(45) Date of Patent: Dec. 11, 2001

(54) TRIBOELECTRIC AIR FILTER

(75) Inventor: Richard Auger, Beauce (CA)

(73) Assignee: Texel Inc., Quebec (CA)

( * ) Notice: Subject to any disclaimer, the term of this patent is extended or adjusted under 35 U.S.C. 154(b) by 0 days.

(21) Appl. No.: 09/700,212

(22) PCT Filed: May 13, 1998

(86) PCT No.: PCT/CA98/00470

§ 371 Date: Feb. 9, 2001

§ 102(e) Date: Feb. 9, 2001

(87) PCT Pub. No.: WO97/44509

PCT Pub. Date: Nov. 27, 1997

(51) Int. Cl.[7] ..... B03C 3/30
(52) U.S. Cl. ..... 96/17; 55/528; 442/361
(58) Field of Search ..... 96/17, 69, 55; 55/527, 528, DIG. 5, DIG. 33, DIG. 35, DIG. 39; 210/510.1, 500.23; 442/361

(56) References Cited

U.S. PATENT DOCUMENTS

| | | | | |
|---|---|---|---|---|
| H1162 | * | 4/1993 | Yamamoto et al. | 156/179 |
| Re. 31,601 | * | 6/1984 | Ikeda et al. | 442/277 X |
| 4,145,468 | * | 3/1979 | Mizoguchi et al. | 442/269 |
| 4,146,663 | * | 3/1979 | Ikeda et al. | 442/276 X |
| 4,430,219 | * | 2/1984 | Kuzumoto et al. | 120/500.23 X |
| 4,781,834 | * | 11/1988 | Sekino et al. | 210/500.23 X |
| 5,037,455 | * | 8/1991 | Scheineson et al. | 55/528 X |
| 5,240,479 | * | 8/1993 | Bachinski | 55/DIG. 33 |
| 5,419,953 | * | 5/1995 | Chapman | 96/69 X |
| 5,470,485 | * | 11/1995 | Morweiser et al. | 96/55 X |
| 5,476,587 | * | 12/1995 | Kuroki et al. | 210/510.1 X |
| 5,707,520 | * | 1/1998 | Kuroki et al. | 210/510.1 X |
| 6,156,841 | * | 12/2000 | Noritomi et al. | 525/78 |

FOREIGN PATENT DOCUMENTS

| | | | |
|---|---|---|---|
| 43 21 289 A1 | | 1/1995 | (DE) . |
| 2 190 689 A | | 11/1987 | (GB) . |
| 11040131 | * | 2/1999 | (JP) . |
| WO 97/44509 | | 11/1997 | (WO) . |

OTHER PUBLICATIONS

"Generation of Triboelectric Charge in Textile Fibre Mixtures, and Their use as Air Filters", P.A. Smith et al., Journal of Electrostatics, vol. 21 (1988), pp. 81–98.

* cited by examiner

*Primary Examiner*—Richard L. Chiesa
(74) *Attorney, Agent, or Firm*—McDermott, Will & Emery

(57) ABSTRACT

The invention concerns a triboelectric air filter consisting essentially of a mixture of polypropylene fibers with polymethaphenylene isophatalamide fibers.

5 Claims, No Drawings

TRIBOELECTRIC AIR FILTER

This application is a national stage of International Application No. PCT/CA98/00470, filed on May 13, 1998.

TECHNICAL FIELD OF THE INVENTION

The present invention relates to a new triboelectric air filter.

TECHNOLOGICAL BACKGROUND

It is known that the air filters that are used in the apparatuses where an air filtration is required, are much more efficient if the material forming the filters contain electric charges.

Such air filters hereinafter called <<electrostatic filters>> are indeed capable of catching a greater amount of dust than the conventional filters which do not have electric charges. This difference comes from the fact that attractive forces are exerted between the material forming the filters and the dust which, in a natural manner, also contains electric charges.

There are presently three methods for obtaining such electrostatic filters.

The first one consists in producing a permanent lack of balance at the molecular level, between the electric charges of a given material. The product obtained by this method is usually called a <<electret>>.

The second method consists in grafting ions, usually by bombardment, in the material forming the filter.

The third method uses the principle of triboelectricity, whereby electric charges are generated when at least two different materials are rubbered together. The product obtained by this third method are usually called <<triboelectric filters>>.

By way of example of reduction to practice of this third method, reference can be made to British patent No. 2,190,689 issued in 1989 in the name of National Research Development Corporation, which discloses a triboelectric air filter consisting of a mixture of (1) polyolefin fibers such as polyethylene, polypropylene or ethylene and propylene copolymers, with (2) fibers of another polymer containing hydrocarbon functions substituted by halogen atoms, such as chlorine. In this British patent, the weight ratio of fibers (2) to fibers (1) ranges between 70:30 and 20:80 and preferably between 60:40 and 30:70.

By way of other examples of reduction to practice of this third method, reference can also be made to U.S. Pat. No. 5,470,485 issued in 1995 in the name of FIRMA CARL FREUDENBERG, which discloses a triboelectric air filter consisting of a mixture of (1) polyolefin fibers with (2) polyacrylonitrile fibers. Once again, the weight ratio of fibers (2) to fibers (1) ranges between 70:30 and 20:80.

In all cases, several important characteristics distinguish the electrostatic filters from each other. These characteristics include the amount of electric charges, the intensity of the generated electrostatic fields, and time duration of the electrical fields. To be efficient, a filter must ideally have a high number of charges which produce intensive electrostatic fields for a period of time at least equal to the life time of the filter.

All these characteristics depend on the method used for producing the charges, from the selection and proportions of the constituting materials of the filters and finally from the conditions of use of the filter. The conditions of use are, due to the existence of a standard method for measuring the efficiency of the filters, implicitly considered as constant. Therefore, this distinction is essentially established at the level of the method of manufacture and the selection of the materials forming the filter.

SUMMARY OF THE INVENTION

It has now been discovered that excellent triboelectric air filters may be obtained when use is made of a mixture of polypropylene fibers with methaphenylene isophtalamide fibers.

More particularly, it has been discovered that triboelectric air filters having an efficiency ranging between 90% and 99% can be obtained in such mixtures, even with relatively low amounts of polymethaphenylene isophtalamide fibers.

The selection of this triboelectric couple of fibers commercially available and simultaneously having all the requested characteristics, was not evident to make. As a matter of fact, it is only after observation of anomalies in published lists of triboelectric couples that the Applicant has started an exhaustive study which has shown that the combination of the above mentioned fibers, have higher properties.

Therefore, the invention relates to a air filter of triboelectric type, characterized in that it consists essentially of a mixture of polypropylene fibers with polymethaphenylene isophtalamide fibers.

DETAILED DESCRIPTION OF THE INVENTION

As previously indicated, the triboelectric air filter according to the invention consists of a mixture of (1) polypropylene fibers with (2) polymethaphenylene isophtalamide fibers.

This mixture is preferably in the form of a non-woven having a weight ratio of fibers (2) to fibers (1) ranging between 5:95 and 50:50, and even more preferably between 10:90 and 30:70. Therefore, as can be noted, the weight ratio of fibers (2) to fibers (1) in the filter according to the invention is much lower than those proposed in the two patents mentioned hereinabove.

Any kind of fibers (1) or (2) can be used. As polymethaphenylene isophtalamide fibers (2), use will preferably be made of those sold under the trademarks NOMEX®, APYEIL® and TEIJINCONEX®.

The weight of the filter and its surface weight (in $g/m^2$) depends on the requested physical properties, such as the pressure loss and filtration efficiency. Typically, the surface mass of the filters should range between 15 and 500 $g/m^2$.

As previously indicated, the triboelectric air filter according to the invention has a filtration efficiency of about 90% to 99%. The pressure loss is usually in the range of 0.1 and 2 mm of water.

Advantageously, these characteristics are stable over the time.

EXAMPLES

Tests were carried out on a filter according to the invention identified hereinafter by the symbol F1. By way of comparison, similar tests were also carried out on a filter of the same composition and the same surface weight but modified by addition of an antistatic agent. This filter is identified by the symbol F2. Further tests were finally carried out on a third filter of the same surface weight available in a market. This known filter is identified hereinafter by the symbol F3.

TABLE I

| IDENTIFICATION OF THE FILTERS | |
|---|---|
| F1 | Filter according to the invention in a form of non-woven having a surface weight of 135 g/m$^2$ and a weight ratio of fibers (2) to fibers (1) equal to 10:90. The fibers (2) had a 1.5 denier titled. The fibers (1) had a size of 3 deniers. |
| F2 | Filter identical to F1 with, in addition, an antistatic agent for inhibiting electric charges. |
| F3 | Filter with a surface weight equal to 135 g/m$^2$, available on a market and produced by a triboelectric process as disclosed in U.S. Pat. No. 5,470,485 |

The results obtained with these different triboelectric filters are as follows:

TABLE 2

| Identification Selection | Surface weight (g/m$^2$) | Efficiency (%) | Pressure loss (mm of water) | Quality Factor |
|---|---|---|---|---|
| F1 | 135 | 98 | 0.5 | 7.8 |
| F2 | 135 | 46 | 0.5 | 0.8 |
| F3 | 135 | 94 | 0.4 | 7.0 |

In the above Table, the quality factor is a numerical value which has been calculated with the following equation $$Q = -\ln\frac{100 - \text{Efficiency}}{100 \times \text{Lost of pressure}}$$

The quality factor permits classifying the efficiency of the filters. The higher the value of <<Q>>, the higher is the quality of the filter.

As can be seen, the filter F1 according to the invention has proved to be more efficient that the known filter F3. The poor results obtained with filter F2 confirm that the electric charges have an important influence of the efficiency of the filter.

The efficiency of the filter F1 according to the invention has shown good stability over the time. This filter was used over two years and no significant difference was noted between the initial value of the efficiency and the subsequent measurements made 4 months and 24 months after its manufacture.

What is claimed is:

1. A triboelectric air filter consisting essentially of a mixture of (1) polypropylene fibers with (2) polymethaphenylene isophatalamide fibers.

2. A filter of claim 1, wherein the fibers (1) and (2) are present in amounts such as the weight ratio of fibers (2) to fiber (1) ranges between 5:95 and 50:50.

3. The filter of claim 2, wherein said weight ratio ranges between 10:90 and 30:70.

4. The filter of claim 1, having a surface weight ranging between 15 and 500 g/m$^2$.

5. The filter of claim 1, which is in the form of a non-woven.

* * * * *